US006939270B2

(12) United States Patent
Wang et al.

(10) Patent No.: US 6,939,270 B2
(45) Date of Patent: Sep. 6, 2005

(54) FOLDABLE TRAMPOLINE

(75) Inventors: Teng Yi Wang, Taipei (TW); Chang I Wu, Taipei (TW)

(73) Assignee: Leisure Kingdom Holding, Inc., San Jose, CA (US)

( * ) Notice: Subject to any disclaimer, the term of this patent is extended or adjusted under 35 U.S.C. 154(b) by 36 days.

(21) Appl. No.: 10/742,831

(22) Filed: Dec. 23, 2003

(65) Prior Publication Data

US 2005/0137061 A1 Jun. 23, 2005

(51) Int. Cl.[7] ..... A63B 21/10
(52) U.S. Cl. ..... 482/27; 482/28; 482/29
(58) Field of Search ..... 482/27–29; 5/111, 5/187, 74, 199, 200.1; 182/139

(56) References Cited

U.S. PATENT DOCUMENTS 4,386,772 A * 6/1983 Wu ..... 482/28
4,415,151 A * 11/1983 Daniels ..... 482/28
4,452,444 A * 6/1984 Schulze, Jr. ..... 482/27
6,110,074 A * 8/2000 Tacquet ..... 482/27
6,237,169 B1 * 5/2001 Ying ..... 5/111
6,648,799 B2 * 11/2003 Hall ..... 482/28

* cited by examiner

*Primary Examiner*—Jerome W. Donnelly
(74) *Attorney, Agent, or Firm*—Troxell Law Office, PLLC

(57) ABSTRACT

A foldable trampoline includes a frame consisting of multiple frame sections, a jumping bed, and a plurality of legs connected to each joint of two adjacent frame sections. At least two knuckle mechanisms are provided at two opposite joints of the frame sections. Each knuckle mechanism includes two clamp brackets that are fixedly connected to two adjacent frame sections at their opposed ends. Each clamp bracket has two spaced arms that forward extend beyond the end of the frame section by a predetermined length and then turn downward to form two lug portions. The lug portions of the two clamp brackets are overlapped and pivotally connected to each other via a shaft pin extended therethrough. The shaft pin also extends through the leg located at the joint, so that the two adjacent frame sections may be pivotally turn about the shaft pin without the need of dismounting the leg thereat.

6 Claims, 5 Drawing Sheets

FOLDABLE TRAMPOLINE

FIELD OF THE INVENTION

The present invention relates to a foldable trampoline, and more particularly to a foldable trampoline that can be conveniently and quickly folded without the need of dismounting all the legs thereof.

BACKGROUND OF THE INVENTION

A trampoline typically includes a frame supported on a floor by a plurality of supporting legs, and a jumping bed tightly stretched over the frame via a plurality of spaced elastic elements. A user may continuously jump on and rebound from the jumping bed as an interesting exercise.

The jumping bed must have a specific size large enough to safely catch the user rebounded from and fallen to the jumping bed again. Therefore, the trampoline in an extended state for use will occupy a considerably large space.

A fixed type of trampoline occupies a large space and results in many inconveniences. For example, the finished product of the fixed type trampoline will occupy a large space in the limited warehouse, the showroom, or the user's house, and requires increased freight.

There has been developed a foldable trampoline to solve the problem of big volume encountered by the conventional fixed type trampoline. U.S. Pat. No. 6,237,169B1 discloses a foldable trampoline, which can be folded to occupy only one half of the original space when all the supporting legs are disassembled from the frame. The disassembled supporting legs must then be reassembled to the frame before the trampoline could be used again. It is, of course, very inconvenient and troublesome to do so.

SUMMARY OF THE INVENTION

It is a primary object of the present invention to provide a foldable trampoline that can be conveniently and quickly folded for storage and extended for use because not all the legs thereof are needed to disassemble when the trampoline is folded.

To achieve the above and other objects, the foldable trampoline according to a preferred embodiment of the present invention includes:

a frame consisting of a plurality of frame sections;

a jumping bed located within the frame;

a plurality of elastic elements, each of which having an outer end fixedly connected to the frame, and an inner end fixedly connected to an outer periphery of the jumping bed, so that the jumping bed is tightly stretched over the frame to provide a required rebounding force;

a plurality of supporting legs separately connected to each joint of two adjacent frame sections; and at least two knuckle mechanisms provided at two opposite joints of the frame sections;

the knuckle mechanism including two clamp brackets separately provided at two opposed ends of two adjacent frame sections; the clamp brackets including a rear end fixedly connected to their respective frame section, and a front end formed into two spaced arms; the front ends of the two clamp brackets extending forward toward one another so as to project beyond the ends of their respective frame sections by a predetermined length, and then turned downward to form two lug portions; the lug portions of the two opposed clamp brackets being overlapped and pivotally connected to each other via a shaft pin extended therethrough; and the shaft pin also being extended through the supporting leg located at that joint, such that the two adjacent frame sections may be pivotally turned about the shaft pin toward two lateral sides of the supporting leg.

According to an alternative embodiment of the present invention, the foldable trampoline includes:

a frame consisting of four frame sections;

a jumping bed located within the frame;

a plurality of elastic elements, each of which having an outer end fixedly connected to the frame, and an inner end fixedly connected to an outer periphery of the jumping bed, so that the jumping bed is tightly stretched over the frame to provide a required rebounding force;

four supporting legs separately connected to each joint of two adjacent frame sections; two of the four supporting legs located at two opposite first joints being movable legs that are detachably screwed to the frame sections, and the other two supporting legs located at two opposite second joints being fixed legs that are pivotally connected to the frame sections;

two first knuckle mechanisms provide at the first joints; and two second knuckle mechanisms provided at the second joints;

the first knuckle mechanism including two long tabs provided at upper and lower sides of an end of a first frame section at the first joint, and two short tabs provided at an end of an adjacent second frame section at the first joint; the long tabs inward and forward extending to project beyond the end of the first frame section by a predetermined length; the short tabs being extended toward and pivotally connected to the projected portion of the long tabs via a shaft pin, and the end of the first frame section at the first joint having a reduced outer diameter that is slightly smaller than an outer diameter of the frame sections forming the frame; and the second knuckle mechanism including two clamp brackets separately provided at two opposed ends of two adjacent frame sections at the second joint; the clamp brackets including a rear end fixedly connected to their respective frame section, and a front end formed into two spaced arms; the front ends of the two clamp brackets extending forward toward one another so as to project beyond the ends of their respective frame sections by a predetermined length, and then turned downward to form two lug portions; the lug portions of the two opposed clamp brackets being overlapped and pivotally connected to each other via a shaft pin extended therethrough; and the shaft pin also being extended through the supporting leg located at that joint, such that the two adjacent frame sections may be pivotally turned about the shaft pin toward two lateral sides of the supporting leg.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
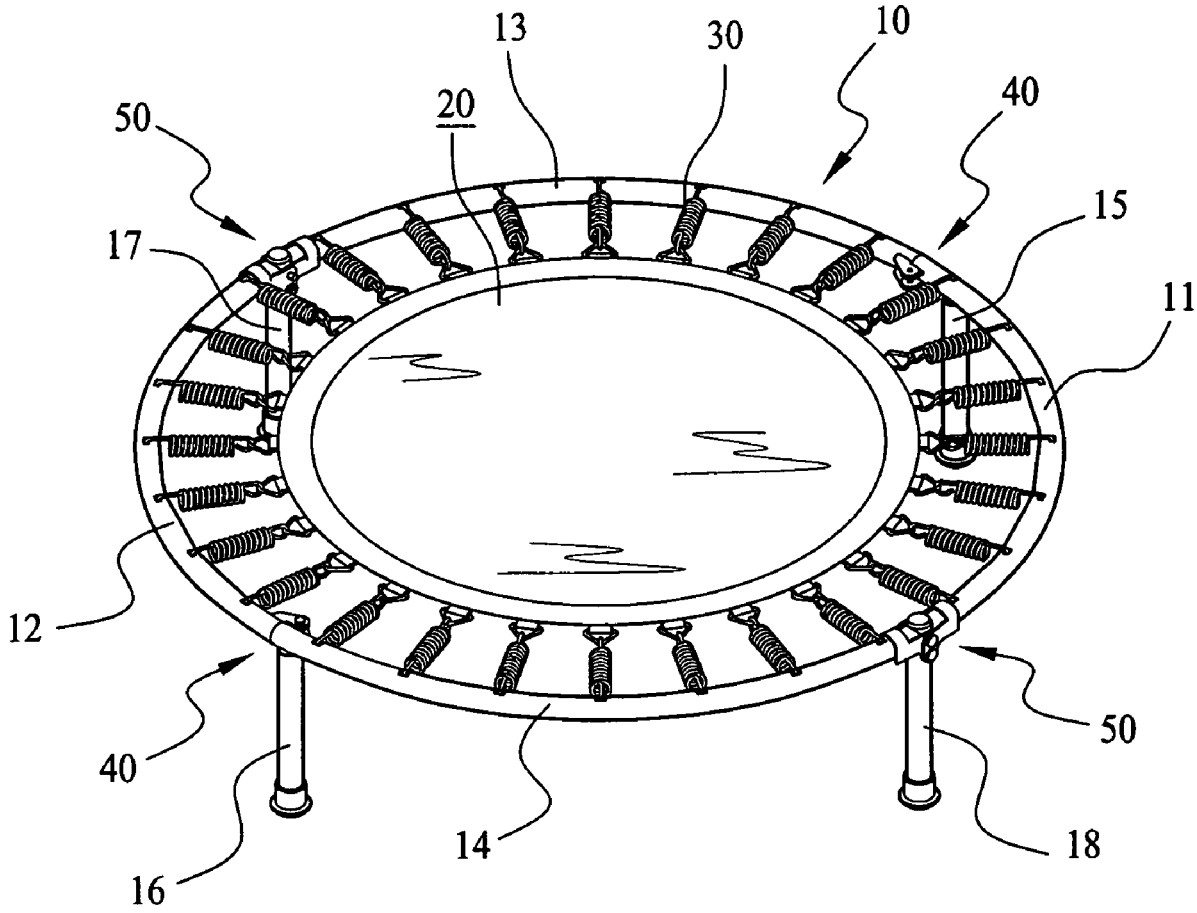
FIG. 1 is a top perspective view of a foldable trampoline according to a preferred embodiment of the present invention.

Please refer to FIG. 1, in which a foldable trampoline according to a preferred embodiment of the present invention is shown. The foldable trampoline includes a round or a square frame 10 that is usually formed from metal tubes, a jumping bed 20 that is usually made of a canvas material, and a plurality of elastic elements 30, which is usually springs, disposed between the frame 10 and the jumping bed 20. Each of the elastic elements 30 has an outer end fixedly connected to the frame 10 and an inner end fixedly connected to an outer periphery of the jumping bed 20, so that the jumping bed 20 is tightly stretched over the frame 10 to provide a required rebounding force.

In the illustrated preferred embodiment, the frame 10 consists of four frame sections 11, 12 and 13, 14. Four supporting legs 15, 16, 17, and 18 are separately provided at four joints of the four frame sections. In other words, in the illustrated embodiment, the four supporting legs are distributed along the frame 10 at intervals of 90 degrees to support the frame 10 and the jumping bed 20 above the floor.

Please refer to FIGS. 1 to 4 at the same time. Two of the four supporting legs 15, 16, which are located at two opposite positions of the frame 10, are detachably connected to the frame 10 and hereinafter referred to as the movable legs. On the other hand, the other two opposite supporting legs 17, 18 are integrally connected to the frame 10 and hereinafter referred to as the fixed legs. When the foldable trampoline of the present invention is to be folded, the movable legs 15, 16 are disassembled from the frame 10. However, the fixed legs 17, 18 are always connected to the frame 10 even the trampoline is in a folded state.

In the illustrated drawings, the frame sections 11, 13 and 12, 14 located at two lateral sides of the movable legs 15 and 16, respectively, are connected to each other via a first knuckle mechanism 40. On the other hand, the frame sections 12, 13 and 11, 14 located at two lateral sides of the fixed legs 17 and 18, respectively, are connected to each other via a second knuckle mechanism 50.

Figure 2:
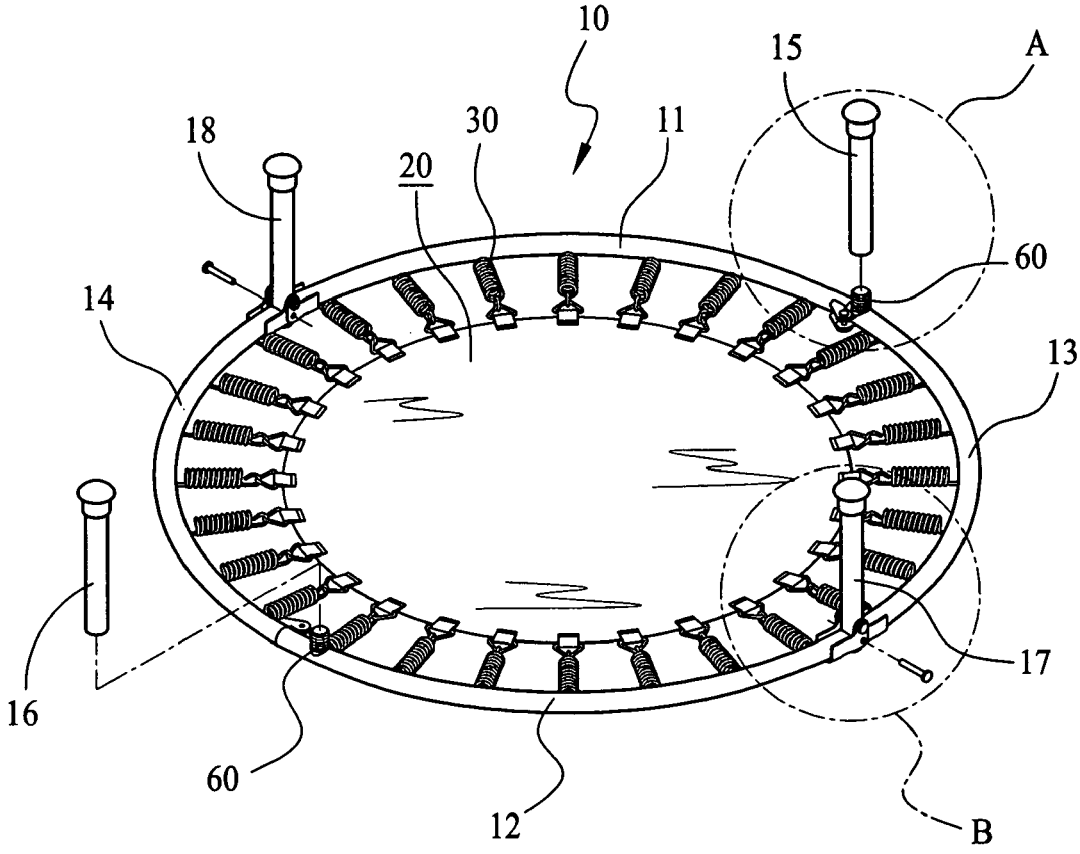
FIG. 2 is a bottom view of FIG. 1 showing the dismounting of some supporting legs from a frame of the trampoline.
Figure 3:
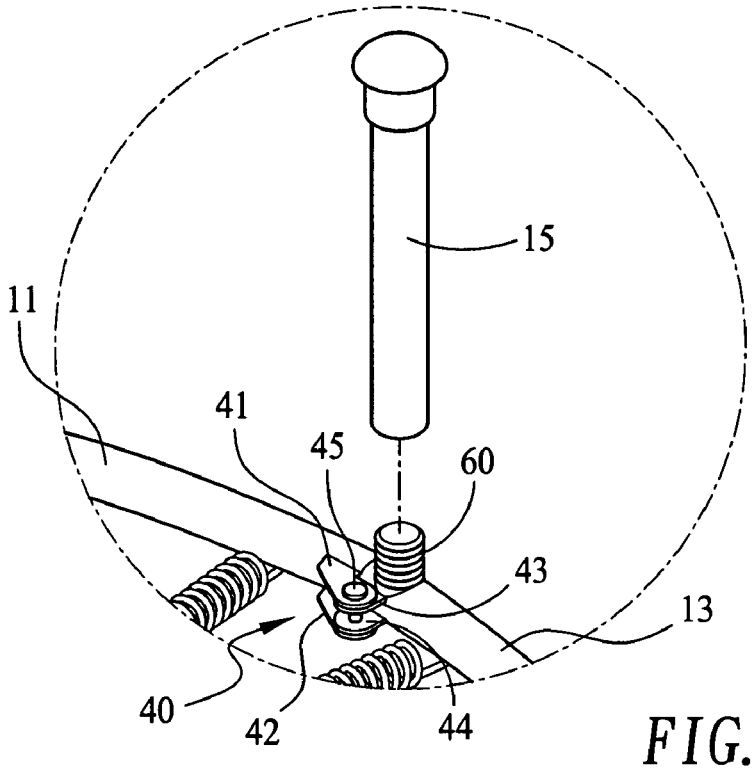
FIG. 3 is an enlarged view of the circled area A of FIG. 2.

An externally threaded tube 60 is downward extended from each joint of the frame sections connected together via the first knuckle mechanism 40 (in FIGS. 2 and 3 that are bottom views of FIG. 1, the tube 60 is pointed upward). Each of the movable legs 15, 16 is provided at an upper end (which is a lower end in FIGS. 2 and 3) with internal screw threads corresponding to the externally threaded tube 60, so that the movable legs 15, 16 may be directly screwed to or loosened from the tube 60. The two fixed legs 17, 18 are integrally and pivotally connected at upper ends (which are lower ends in FIGS. 2 and 3) to the second knuckle mechanisms 50.

Figure 7:
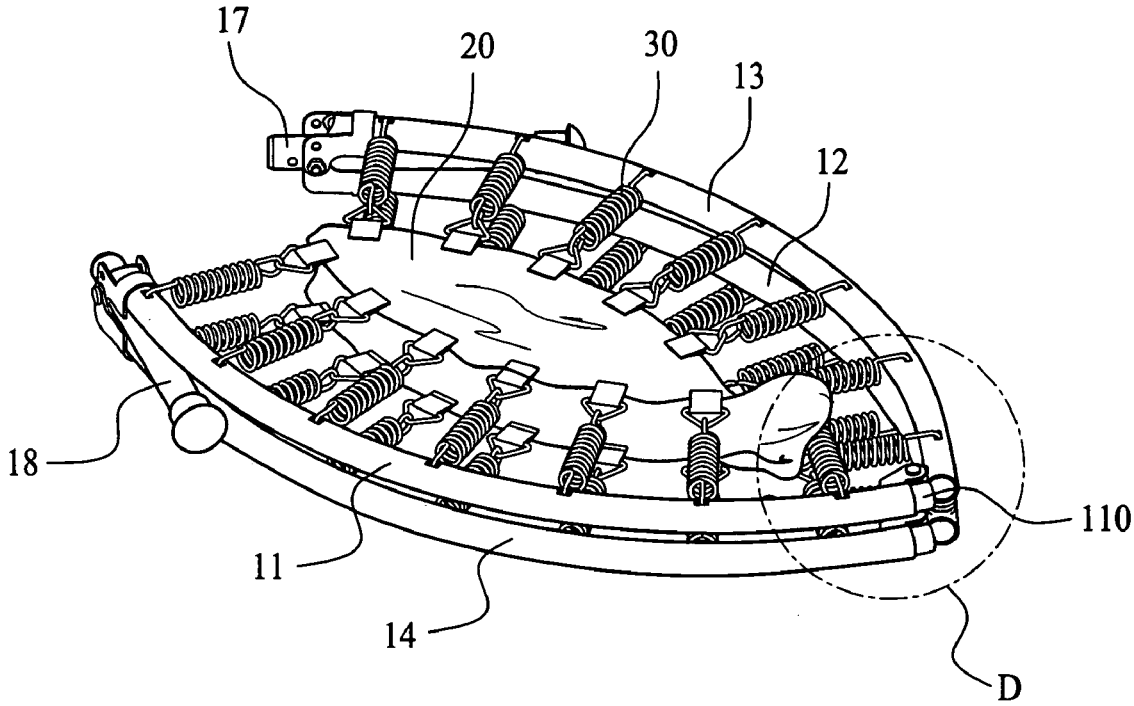
FIG. 7 shows the second step of folding the trampoline of the present invention.
Figure 8:
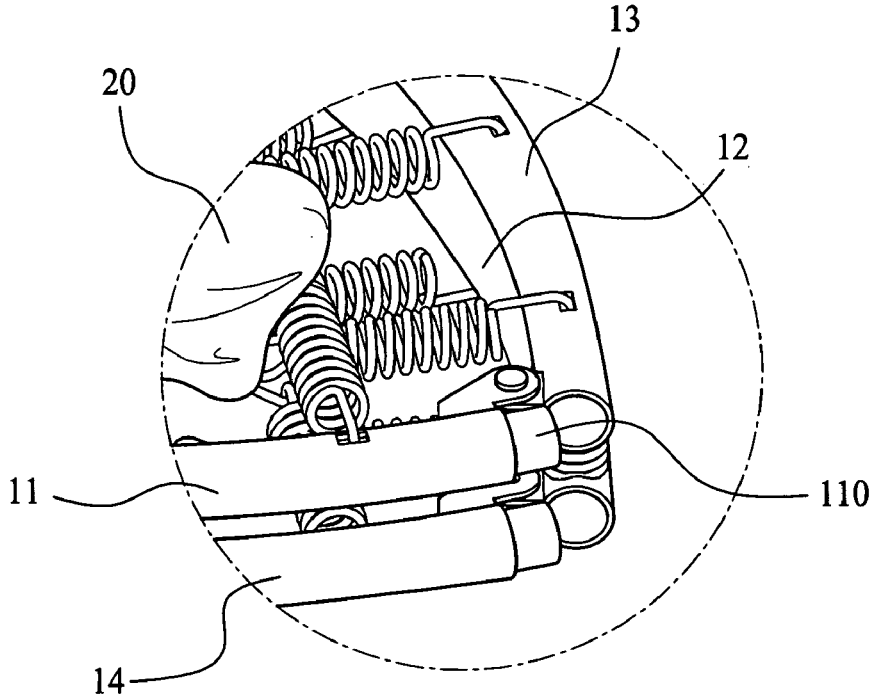
FIG. 8 is an enlarged view of the circled area D of FIG. 7.

Please refer to FIGS. 3, 7, and 8 at the same time. In the illustrated embodiment, the first knuckle mechanism includes two long tabs 41, 42 provided at upper and lower sides of a first end of one of the two adjacent frame sections 11, 13 or 12, 14 (it is the frame section 11 in the illustrated drawings), and two short tabs 43, 44 provided on a first end of the other one of the two adjacent frame sections 11, 13 or 12, 14 (it is the frame section 13 in the illustrated drawings). The long tabs 41, 42 are extended from the frame section 11 toward an inner side of the frame 10 to project beyond the first end of the frame section 11 by a predetermined length. The short tabs 43, 44 are extended toward and pivotally connected to the portion of the long tabs 41, 42 projected beyond the end of the frame section 11 via a shaft pin 45. It is noted the first end of the frame section 11 has a reduced outer diameter 110 that is slightly smaller than an outer diameter of the frame sections forming the frame 10, as can be seen from FIG. 8.

Figure 4:
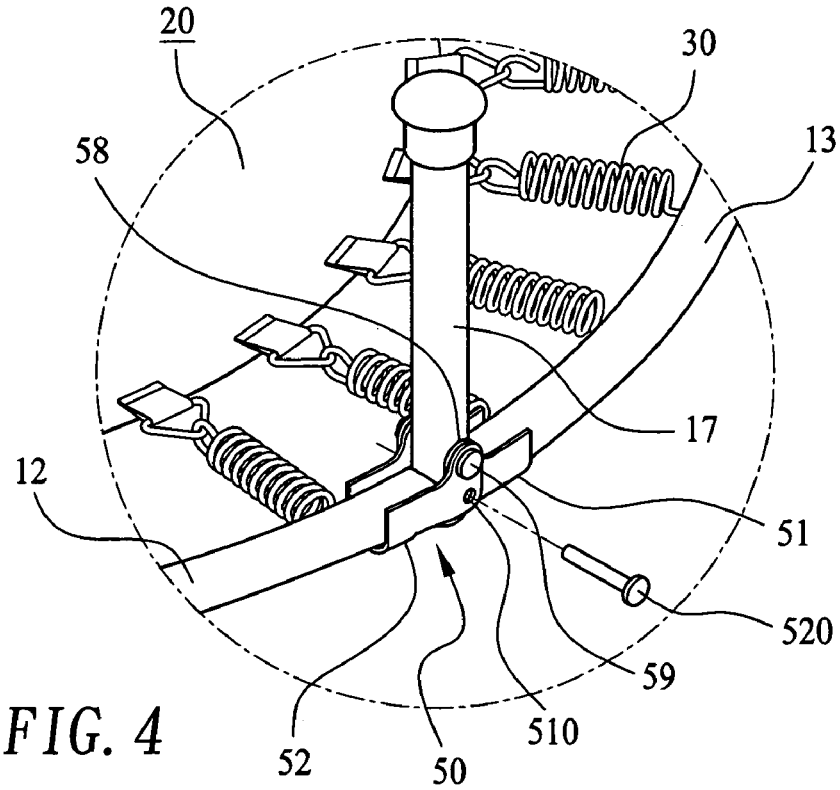
FIG. 4 is an enlarged view of the circled area B of FIG. 2.
Figure 5:
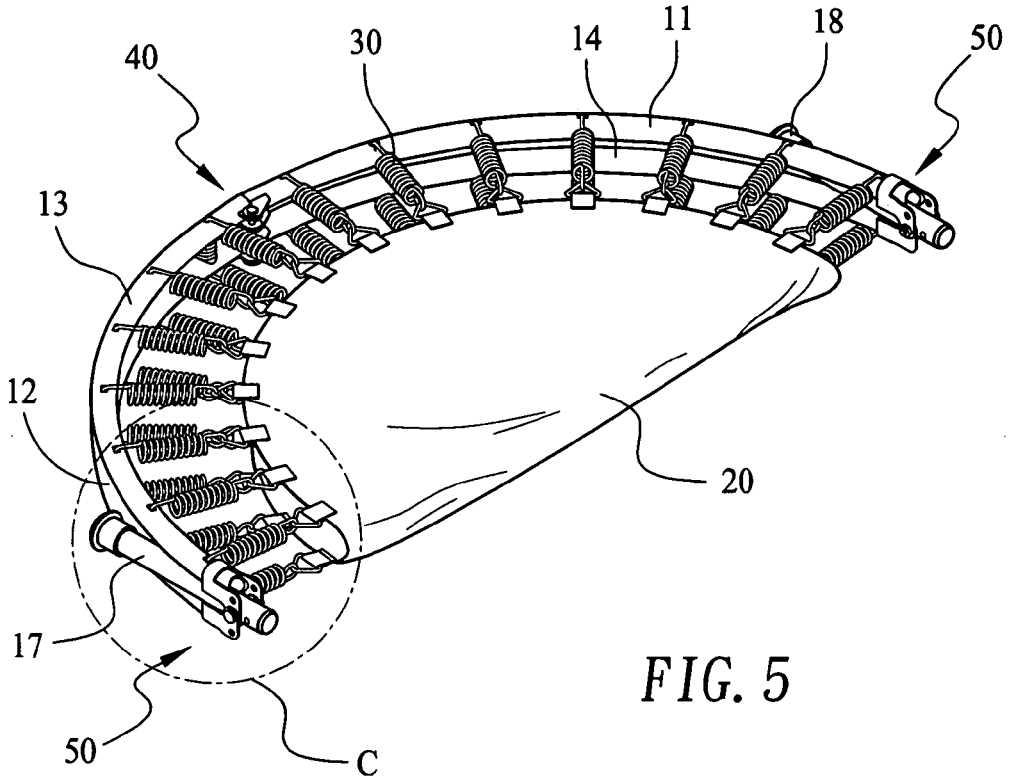
FIG. 5 shows the first step of folding the trampoline of the present invention.
Figure 6:
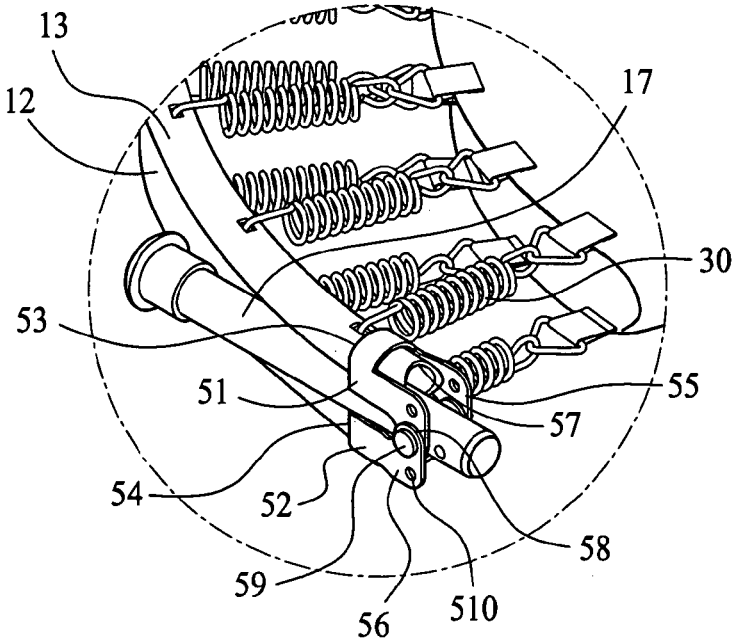
FIG. 6 is an enlarged view of the circled area C of FIG. 5.

Please now refer to FIGS. 4, 5, and 6 at the same time. In the illustrated embodiment, the second knuckle mechanism 50 mainly includes two clamp brackets 51, 52 separately provided at a second end 57 of the two adjacent frame sections 13, 12 or 11, 14 (it is the frame sections 13, 12 in the illustrated drawings). The clamp brackets 51, 52 have similar downward opened configuration and are symmetrically and oppositely disposed on the second ends of the frame sections 13, 12. The clamp brackets 51, 52 have rear ends 53, 54 pointed away from the second end of the frame sections 13, 12 and welded to the frame sections 13, 12 (or 11, 14), and front ends 55, 56 formed into two spaced arms.

The front ends 55, 56 of the clamp brackets 51, 52 forward extend beyond the second ends 57 of the frame sections 13, 12 (or 11, 14) by a predetermined length, as shown in FIG. 6. Moreover, the two spaced arms of the respective front ends 55, 56 of the clamp brackets 51, 52 are turned downward to form two overlapped pairs of lug portions 58. A shaft pin 59 is extended through the overlapped lug portions 58 and the fixed leg 17 (or 18) located at the joint of the frame sections 13, 12 (or 11, 14), so that the frame sections 13, 12 (or 11, 14) and the fixed leg 17 (or 18) are pivotally connected to one another.

The length by which the front ends 55, 56 of the clamp brackets 51, 52 extend beyond the second ends 57 of the frame sections 13, 12 is equal to or slightly larger than a distance by which the second ends 57 of the frame sections 13, 12 are displaced when they are pivotally turned about the shaft pin 59 by 90 degrees. In the illustrated embodiment, the second ends 57 having been pivotally turned about the shaft pin 59 by 90 degrees are abutted on two lateral sides of the upper end of the fixed leg 17 (or 18). Therefore, it is preferable for the second ends 57 of the frame sections 13, 12 and 11, 14 to be inward curved corresponding to an outer peripheral configuration of the fixed legs 17, 18. Meanwhile, the shaft pin 59 is extended through the fixed leg 17, 18 at a point determined according to a distance with which the frame sections 13, 12 are allowed to pivotally turn to two lateral sides of the fixed leg 17, 18.

Although not a requisite, it is preferable for each of the two pairs of overlapped lug portions 58 to have two through holes 510 provided thereon opposite to the shaft pin 59, so that a safety pin 520 may be inserted into the through holes 510 when the frame sections 13, 12 and 11, 14 are in a fully extended position, as shown in FIG. 4.

When the foldable trampoline of the present invention is fully extended as shown in FIG. 1, it is ready for use. And, to fold the trampoline, the two movable legs 15, 17 are first detached from the externally threaded tubes 60, as shown in FIG. 2, and then two halves of the frame 10 at two opposite sides of the two second knuckle mechanisms 50 are directly turned toward each other into a flat state, as shown in FIG. 5. Thereafter, two lateral parts of the two overlapped halves of the frame 10 located at two opposite sides of the two first knuckle mechanism 40 are further turned toward each other into a fully folded state, as shown in FIG. 7. To extend the folded trampoline into the fully stretched state as shown in FIG. 1, simply repeat the above procedures reversely.

The present invention has been described with a preferred embodiment thereof and it is understood that many changes and modifications in the described embodiment can be carried out without departing from the scope and the spirit of the invention that is to be limited only by the appended claims. For example, the present invention shall include a foldable trampoline that includes only the second knuckle mechanisms 50 for the frame 10 to fold only once into the flat state as shown in FIG. 5.

What is claimed is:

1. A foldable trampoline, comprising:

a frame consisting of a plurality of frame sections;

a jumping bed located within said frame;

a plurality of elastic elements, each of which having an outer end fixedly connected to said frame, and an inner end fixedly connected to an outer periphery of said jumping bed, so that said jumping bed is tightly stretched over said frame to provide a required rebounding force; and a plurality of supporting legs separately connected to each joint of two said frame sections that are adjacent to one another; and at least two knuckle mechanisms provided at two opposite ones of said joints of said frame sections;

said knuckle mechanism including two clamp brackets separately provided at two opposed ends of two said adjacent frame sections at said joint; said clamp brackets being fixedly connected at respective rear ends to said frame sections, and having a front end formed into two spaced arms; said front end of each said clamp bracket extending forward to project beyond said end of said frame sections by a predetermined length and then turned downward to form two lug portions; said lug portions of said two opposed clamp brackets being overlapped and pivotally connected to each other via a shaft pin extended therethrough; and said shaft pin also being extended through one said supporting leg located thereat, such that two said frame sections connected via said knuckle mechanism may be pivotally turned about said shaft pin toward two lateral sides of said supporting leg located thereat.

2. The foldable trampoline as claimed in claim 1, wherein said spaced arms at said front end of each said clamp bracket are extended beyond said end of said frame section by a length not smaller than a distance by which said end of said frame section is displaced when being pivotally turned about said shaft pin by 90 degrees.

3. The foldable trampoline as claimed in claim 1, wherein said overlapped lug portions of said two clamp brackets are correspondingly provided at a point opposite to said shaft pin with through holes; and a safety pin being adapted to insert through said through holes when said trampoline is in a fully extended state.

4. A foldable trampoline, comprising:

a frame consisting of four frame sections;

a jumping bed located within said frame;

a plurality of elastic elements, each of which having an outer end fixedly connected to said frame, and an inner end fixedly connected to an outer periphery of said jumping bed, so that said jumping bed is tightly stretched over said frame to provide a required rebounding force;

four supporting legs separately connected to each joint of two said frame sections that are adjacent to one another; two of said four supporting legs located at two opposite first joints being movable legs that are detachably screwed to said frame sections, and the other two of said supporting legs located at two opposite second joints being fixed legs that are pivotally connected to said frame sections;

two first knuckle mechanisms provide at said first joints; and two second knuckle mechanisms provided at said second joints;

said first knuckle mechanism including two long tabs provided at upper and lower sides of an end of a first one of said frame sections at said first joint, and two short tabs provided at an end of a second one of said frame sections at said first joint; said long tabs inward and forward extending to project beyond the end of said first frame section by a predetermined length; said short tabs being extended toward and pivotally connected to the projected portion of said long tabs via a shaft pin, and said end of said first frame section at said first joint having a reduced outer diameter that is slightly smaller than an outer diameter of said frame sections forming said frame; and said second knuckle mechanism including two clamp brackets separately provided at two opposed ends of two said adjacent frame sections at said second joint; said clamp brackets being fixedly connected at respective rear ends to said frame sections, and having a front end formed into two spaced arms; said front end of each said clamp bracket extending forward to project beyond said end of said frame sections by a predetermined length and then turned downward to form two lug portions; said lug portions of said two opposed clamp brackets being overlapped and pivotally connected to each other via a shaft pin extended therethrough; and said shaft pin also being extended through one said supporting leg located thereat, such that two said frame sections connected via said knuckle mechanism may be pivotally turned about said shaft pin toward two lateral sides of said supporting leg located thereat.

5. The foldable trampoline as claimed in claim 4, wherein said spaced arms at said front end of each said clamp bracket are extended beyond said end of said frame section by a length not smaller than a distance by which said end of said frame section is displaced when being pivotally turned about said shaft pin by 90 degrees.

6. The foldable trampoline as claimed in claim 4, wherein said overlapped lug portions of said two clamp brackets are correspondingly provided at a point opposite to said shaft pin with through holes; and a safety pin being adapted to insert through said through holes when said trampoline is in a fully extended state.

* * * * *